US007492052B2

(12) United States Patent
Stumm

(10) Patent No.: US 7,492,052 B2
(45) Date of Patent: Feb. 17, 2009

(54) ELECTRONICALLY MODERATED EXPANSION ELECTRICAL GENERATOR

(75) Inventor: Robert E. Stumm, Newport News, VA (US)

(73) Assignee: Northrop Grumman Corporation, Los Angeles, CA (US)

( * ) Notice: Subject to any disclaimer, the term of this patent is extended or adjusted under 35 U.S.C. 154(b) by 109 days.

(21) Appl. No.: 11/562,186

(22) Filed: Nov. 21, 2006

(65) Prior Publication Data

US 2008/0116693 A1 May 22, 2008

(51) Int. Cl.
*H02K 33/00* (2006.01)

(52) U.S. Cl. ..... 290/2

(58) Field of Classification Search ..... 290/2
See application file for complete search history.

(56) References Cited

U.S. PATENT DOCUMENTS 3,675,031 A * 7/1972 Lavigne ..... 290/1 R
4,306,414 A * 12/1981 Kuhns ..... 60/510
4,454,426 A * 6/1984 Benson ..... 290/1 R
4,649,283 A * 3/1987 Berchowitz et al. ..... 290/1 R
5,272,879 A 12/1993 Wiggs
5,924,287 A 7/1999 Best
6,484,498 B1 11/2002 Bonar, II
6,871,495 B2 * 3/2005 Lynch et al. ..... 60/522
6,914,351 B2 * 7/2005 Chertok ..... 310/12
7,082,909 B2 * 8/2006 Graf et al. ..... 123/46 E
7,200,994 B2 * 4/2007 Chertok ..... 60/518

* cited by examiner

*Primary Examiner*—Joseph Waks
(74) *Attorney, Agent, or Firm*—Alston & Bird LLP

(57) ABSTRACT

An electrical generator for use in conjunction with a heat exchange system having an evaporator and a condenser is presented. The electrical generator may include a control circuit, a moderator and a working spool. The moderator may include a moderator cylinder having a moderator chamber and three moderator ports in fluid communication with the moderator chamber. The three moderator ports are respectively in fluid communication with the evaporator, the condenser and the working spool. The moderator and working spool each may include a coil surrounding at least a portion of a cylinder having a piston slidably disposed therein. The working spool coil is configured for generating current upon movement of the working spool piston. Movement of the working spool piston is achieved through the selective admission of the working fluid to the working spool as controlled by the moderator and the control circuit.

19 Claims, 16 Drawing Sheets

ELECTRONICALLY MODERATED EXPANSION ELECTRICAL GENERATOR

BACKGROUND OF THE INVENTION

This invention relates generally to generation of electricity. More specifically, the invention relates to a generator that converts energy supplied by expanding gases and increased pressure into electrical energy.

In satisfying energy needs for the future, increasing attention is being paid to smaller, localized power sources distributed through the power consuming community as an alternative to large centralized power plants. Large centralized power plants generally require large electrical distribution networks with long power transmission lines to provide the power produced to customers. Such large power transmission losses are typically associated with such distribution networks.

The systems used in large centralized power plants often include rotating devices, such as steam or gas turbines or Pelton wheels. However, when scaled down for use in smaller power generation systems, high rotation speeds must be achieved to maintain acceptable system efficiencies. Such high rotations speeds often cannot be achieved without uncommon materials and/or precision machining, each of which results in increased system cost.

Accordingly, a localized system of producing electrical energy that may operate with acceptable efficiencies without costly manufacturing processes is desirable.

Greater attention is being paid to renewable energy sources, such as solar power, as an environmentally favorable alternative to fossil fuels. It is known in the art to capture solar energy and transform it into electrical power using photovoltaic systems However, photovoltaic systems traditionally have low efficiencies that often undermine the economic viability of such systems. Accordingly, energy production systems that utilize solar energy to produce electrical power while maintaining acceptable efficiencies are desirable.

Moreover, it is desirable for an energy production system to utilize waste heat from other processes to produce electrical energy. The use of waste heat to generate electrical power that may be returned to an underlying process may increase the efficiency of the underlying process, require less energy input, and accordingly, less cost to operate.

Power generation with mechanical devices that utilize a reciprocating piston are known, as are systems that utilize a second piston in a spool (e.g., a valve) to moderate a working piston. However, such systems are typically arranged in a manner that the electrical power that is produced is input into a rotating shaft that may drive an electrical generation device. As discussed above, rotating devices often require high rotating speeds and/or precision machining to achieve acceptable efficiencies Additionally, electrical generation by a magnetized piston reciprocating through a spool is also known. However, the force supplied to move the magnetized piston through the spool typically produced through mechanical means.

It is accordingly desirable to provide a power generation system that utilizes heat and its corresponding effect on fluid to cause a magnetized piston to reciprocate through a coil in order to generate electrical power. The heat utilized in the power generation system may be dedicated heat, waste heat, or may be supplied by solar power.

SUMMARY OF THE INVENTION

Aspects of the invention may include systems and methods for generating electricity with an electronically moderated expansion electrical generator. An electrical generator according to a particular aspect of the invention may be used in conjunction with a heat exchange system having an evaporator and a condenser adapted for operating on a working fluid. The evaporator may have an evaporator intake port for receiving working fluid in a liquid state and an evaporator outflow port for transmission of working fluid in a gaseous state, and the condenser may have a condenser intake port for receiving working fluid in a gaseous state and a condenser outflow port for transmission of fluid in a liquid state. The electrical generator comprises a control circuit, a moderator and a working spool. The control circuit comprises an electrical storage module and a timing module. The moderator comprises a moderator cylinder having a moderator chamber and first, second and third moderator ports in fluid communication with the moderator chamber. The first moderator port is also in fluid communication with the evaporator outflow port and the third moderator port is also in fluid communication with the condenser intake port. The moderator further comprises a moderator coil surrounding at least a portion of the moderator cylinder. The moderator coil is in electrical communication with the control circuit. A moderator piston comprising a magnetic body is slidably disposed in the moderator chamber. The moderator piston is capable of translating between a first position wherein the first moderator port and the second moderator port are in fluid communication and a second position wherein the third moderator port and the second moderator port are in fluid communication. The working spool comprises a working spool cylinder having a working spool chamber and first, second and third working spool ports. The first working spool port is in fluid communication with the second moderator port, the second working spool port is in fluid communication with the condenser outflow port, and the third working spool port is in fluid communication with the evaporator inlet. A working spool coil surrounds at least a portion of the working spool cylinder. The working spool coil is in electrical communication with the control circuit. A working spool piston comprising a magnetic body is slidably disposed in the working spool chamber. The working spool piston divides the working spool chamber into a condenser side volume in fluid communication with the first working spool port and an evaporator side volume in fluid communication with the second working spool port. The working spool piston is capable of translating between a first position in which the second working spool port is in fluid communication with the condenser side volume and a second position wherein the second working spool port is closed. The first working spool port is configured and positioned so that when pressurized fluid is received through the first port, the pressurized fluid causes the working spool piston to translate from the first position to the second position.

It is to be understood that both the foregoing general description and the following detailed description are exemplary and explanatory only, and are not restrictive of the invention as claimed. The accompanying drawings constitute a part of the specification, illustrate certain embodiments of the invention and, together with the detailed description, serve to explain the principles of the invention.

DESCRIPTION OF THE DRAWINGS

In order to assist in the understanding of the invention, reference will now be made to the appended drawings, in which like reference characters refer to like elements. The drawings are exemplary only, and should not be construed as limiting the invention.

DETAILED DESCRIPTION OF THE INVENTION

Figure 1:
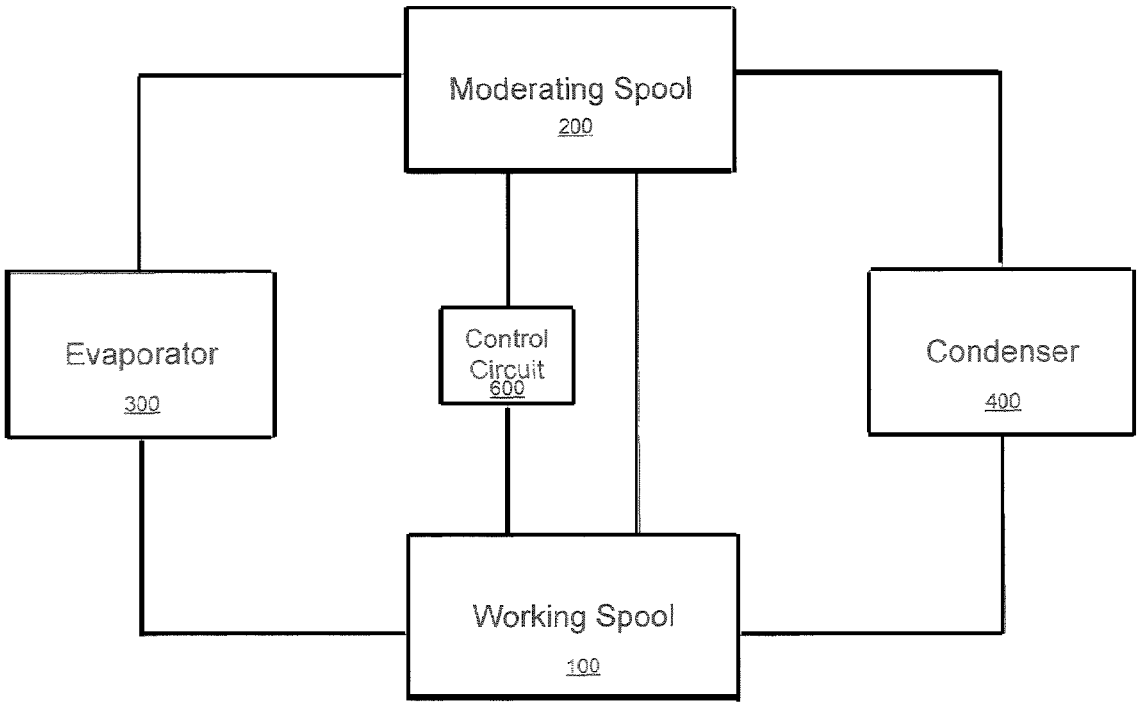
FIG. 1 depicts a block diagram of an electrically moderated expansion electrical generator in accordance with some embodiments of the present invention.

Reference will now be made in detail to embodiments of the invention, examples of which are illustrated in the accompanying drawings With reference to FIG. 1, a power generation system 10 in accordance with some embodiments of the present invention will now be discussed. The power generation system 10 may generally comprise a working spool 100, a moderating spool 200, an evaporator 300, a condenser 400, and a control circuit 600. The working spool 100 comprises a piston that may be magnetized or may have magnets attached thereto disposed in a cylinder, and a coil surrounding the cylinder. The working spool 100 is fluidically connected to the moderating spool 200, the evaporator 300, and the condenser 400. Such connections may be via tubing 500, which may be any tubing, piping, or conduit sufficient to cause communication of fluids in both gaseous and liquid phases.

Similar to the working spool 100, the moderating spool 200 comprises a piston that may be magnetized or may have magnets attached thereto disposed in a cylinder, and a coil surrounding the cylinder. The moderating spool is also fluidically connected to the working spool 100, the evaporator 300, and the condenser 400 via tubing 500.

The evaporator 300 may be any body that contains a fluid that, when heat is applied, causes the fluid to evaporate from its liquid state to a gaseous state. The evaporator 300 is exposed to a heat source (not shown) and may be connected to the working spool 100 and moderating spool 200 via the tubing 500.

In contrast to the evaporator 300, the condenser 400 is any body that causes a fluid in a gaseous state to cool and return to its liquid state. The condenser 400 may include a cooling device, such as but not limited to, a fan. The condenser 400 is also connected to the working spool 100 and moderating spool 200.

The control circuit 600 controls the interactions and the timing of the working spool 100 and the moderating spool 200, and is electrically connected to the working spool 100 and the moderating spool 200. The control circuit 600 may include various electronic components, including a power source and/or power storage device.

Figure 2:
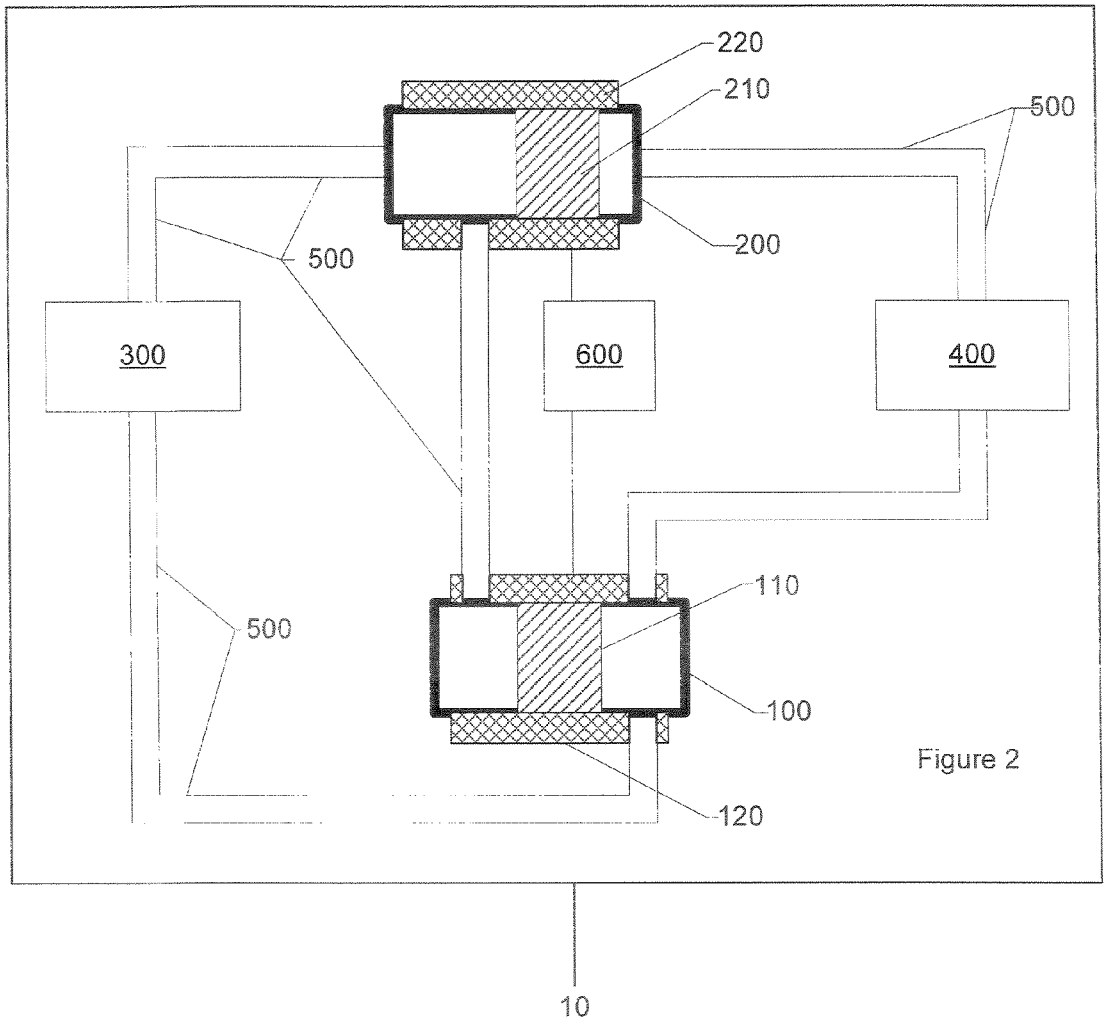
FIG. 2 depicts generalized schematic diagram of an electrically moderated expansion electrical generator in accordance with some embodiments of the present invention.

With reference to FIGS. 1 and 2, generalized operation of the power generation system 10 will now be discussed. Heat may be applied to the evaporator 300, causing fluid therein to evaporate from its liquid state to a gaseous state. Such evaporation provides pressure through the open moderating spool 200 onto one surface of the a piston 110 in the working spool 100. A small amount of electrical energy may be supplied from the control circuit 600 to the working spool coil 120 in order to prevent the working spool piston 110 from moving under the pressure. Once sufficient pressure has built up, the electrical current from the control circuit 600 is ceased, and the working spool piston 110 is subject to the increased pressure from the evaporator 300.

The increased pressure may cause the magnetized working spool piston 110 to slide in its cylinder and accordingly through the working spool coil 120. As the working spool piston 110 slides through the working spool coil 120, electrical energy is created, and may be captured by the control circuit 600 and stored in a power storage device (e.g., battery). Additionally, as the working spool piston 110 slides in its cylinder, it presents additional volume for the gaseous fluid to expand to. In order to maintain increased pressure, condensate from the condenser 400 may be fed to the evaporator 300 via the working spool 100. Once the working spool piston 110 has completed its stroke, it obstructs the flow of condensate from the condenser 400 to the evaporator 300. This prevents additional fluid pressure from being generated by the evaporator 300.

The moderating spool 200 may now be activated by the control circuit 600. The control circuit 600 supplies electrical power to the moderating spool 200, causing the magnetized moderating spool piston 210 to slide within its bore. When the moderating spool piston 210 has completed its travel, it opens a pathway from the working spool 100 to the condenser 400. The gases trapped in the working spool 100 may therefore travel into the condenser 400. The gases may be condensed to their liquid phase for later use.

The control circuit 600 now supplies electrical power to the working spool 100, in order to cause the working spool piston 100 to move within it bore and return to its starting position. By applying a current through the working spool coil 120, the working spool piston 110 is caused to move. As the working spool piston 110 moves within its bore, it forces any additional gases out of the working spool cylinder and to the condenser 400. During this motion, the working spool piston 110 may also draw condensate from the condenser 400 that is supplied to the evaporator 300. Once the working spool piston 110 is back in its original position, the moderating spool piston 210 returns to its original position, either by utilizing electric power from the control circuit 600, or by being forced back into its original position by the expanding gases of the evaporator 300. Once the moderating piston is back to its original position, the system 10 is recharged and ready to repeat the process.

The system described above is a closed loop system in which the working fluid is repeatedly caused to change phase through the use of an evaporator and a condenser. It will be understood, however, that some embodiments of the invention make use of an open system in which the working fluid is continually exhausted and replenished. In such embodiments, the evaporator may be replaced by any fluid source providing fluid at high pressure (and, in many cases, high temperature) and the condenser may be replaced by any exhaust environment at a lower pressure than that of the fluid source. Typically in such embodiments working fluid is not recaptured. One example of such a system is one in which the working fluid is the exhaust from an internal combustion engine and the exhaust environment is the atmosphere.

Figure 3:
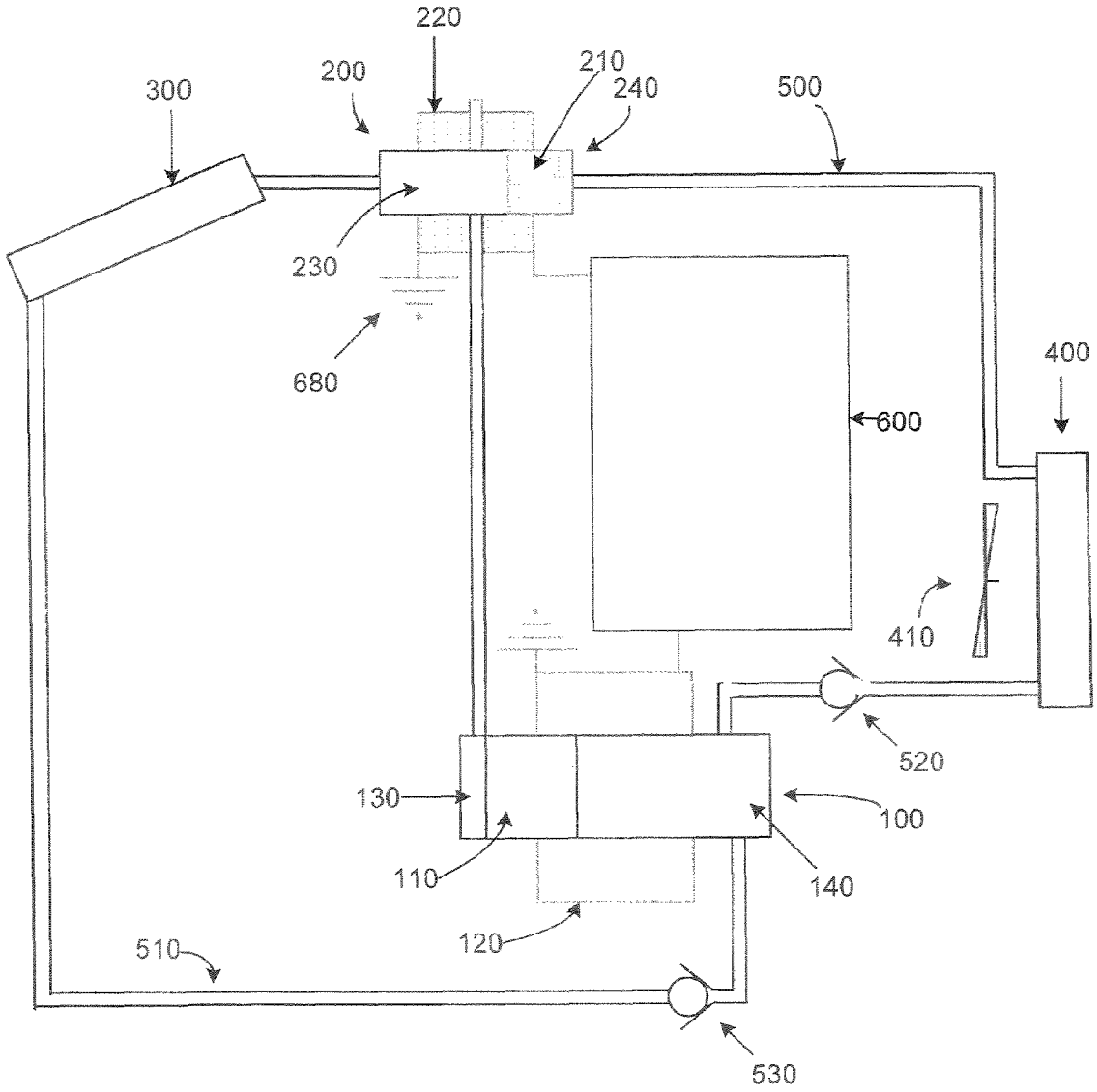
FIG. 3 depicts an electrically moderated expansion electrical generator according to some embodiments of the invention.

With reference to FIG. 3, power generation system in accordance with some embodiments of the present invention will now be discussed in more detail. A working spool 100 comprises a cylinder divided into two sides, a working evaporator side 130 and a working condenser side 140. These sides are separated by a working spool piston 110. The working spool piston 110 may be magnetized or may have magnets attached thereto. A working spool coil 120 surrounds at least a portion of the working spool cylinder. The working spool cylinder comprises a first port, a second port, and a third port. The first port provides communication between the working evaporator side 130 and the moderating spool 200. The second port provides communication between the working condenser side 140 and the condenser 400. The third port provides communication between the working condenser side 140 and the evaporator 300.

Similarly, the moderating spool 200 comprises a cylinder divided into two sides, a moderating evaporator side 230 and a moderating condenser side 240. These sides are separated by moderating spool piston 210. The moderating spool piston 210 may be magnetized or may have magnets attached thereto. A moderating spool coil 220 surrounds at least a portion of the moderating spool cylinder. The moderating spool cylinder may comprise a first port, a second port, and a third port. The first port provides communication between the moderating evaporator side 230 of the moderating spool and the evaporator 300. The second port provides communication between the moderating evaporating side 230 of the moderating spool and the working evaporator side 130 of the working spool, via the working spool's first port. The third port provides communication between the moderating condenser side 240 of the moderating spool and the condenser 400.

Tubing 500 may connect the working condenser side 140 to the condenser 400. Tubing 500 may connect the working condenser side 140 to the evaporator 300. The tubing 500 from the condenser 400 to the working condenser side 140 and the tubing 500 from the working condenser side 140 to the evaporator 300 may be arranged such that there may be fluidic communication from the condenser 400 to the evaporator 300 via the working condenser side 140. This fluidic communication may be prevented when the working spool piston 110 slides in the working spool cylinder into the working condenser side 140. Alternatively, tubing 500 from the condenser 400 may connect directly to the evaporator 300.

The evaporator 300 is connected to the moderating spool 200 via additional tubing 500. The moderating spool 200 is connected to the working spool 100 and the condenser 400 via additional tubing 500.

As can be seen from FIG. 3, check valves 520, 530 may be used to prevent fluids from passing through the tubing in an undesirable direction. A first check valve 520 prevents fluid from traveling from the working spool 100 to the condenser 400, while a second check valve 530 prevents fluid from traveling from the evaporator to compression volume 140 of the working spool 100.

The electrical circuit 600 is used to regulate the power generation system, and may be used to store or transfer generated electrical power. The electrical circuit 600 is electrically connected to the working spool solenoid 120 and the moderating spool solenoid 220. In this manner, the electrical circuit can provide electricity to, and receive generated electricity from, the working spool solenoid 120 and/or the moderating spool solenoid 220. The specific orientation and components selected for the electrical circuit 600 may be any that allow the electrical circuit to control the working spool 100 and the moderating spool 200, and selectively provide electricity to, and receive electricity from, the working spool 100 and the moderating spool 200.

Figure 4:
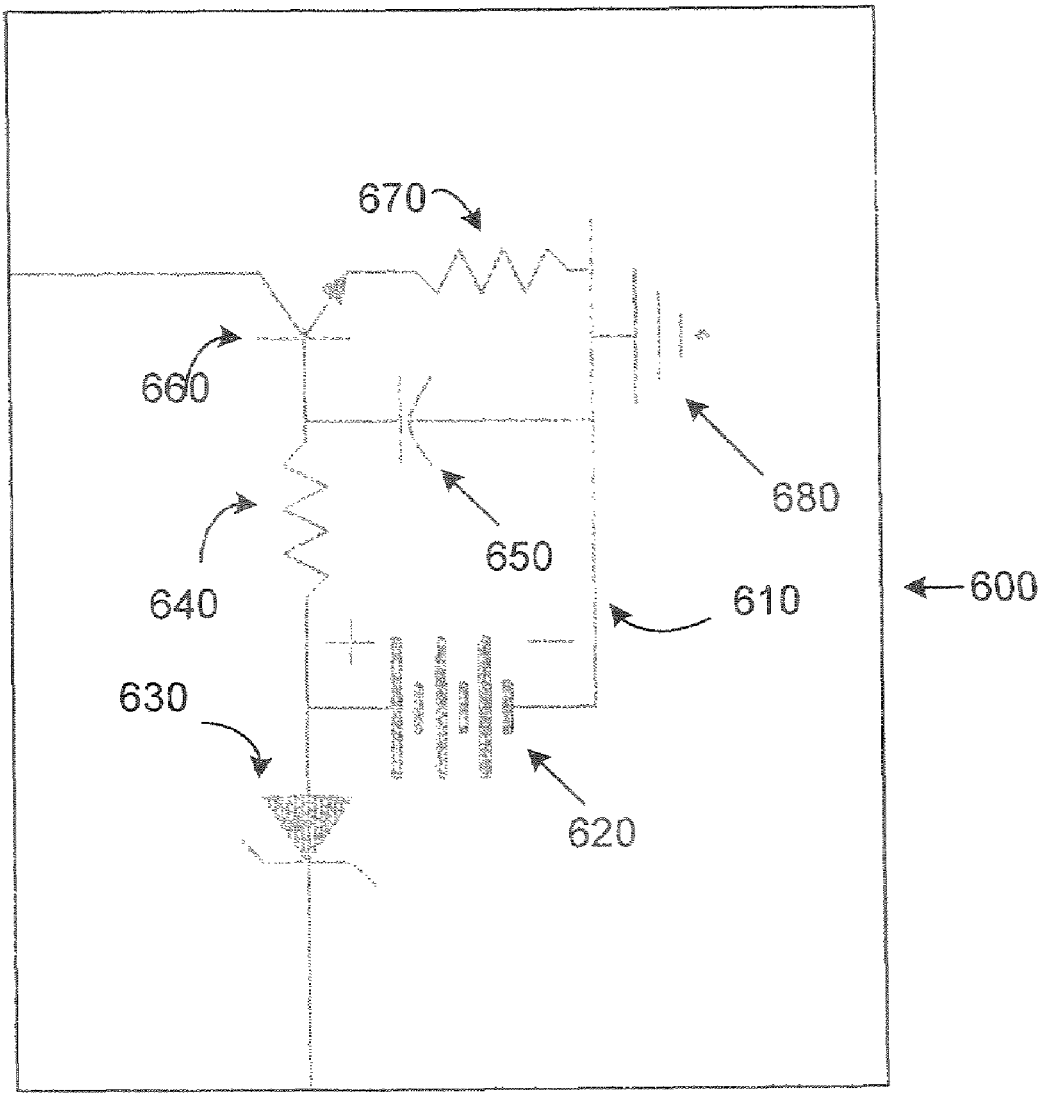
FIG. 4 depicts the electrical circuit of an electrically moderated expansion electrical generator according to some embodiments of the invention.

With reference to FIG. 4, the electrical circuit 600 generally comprises a power storage device (e.g., a battery) 620, a diode 630, a first and second resistor 640, 670, a capacitor 650, and a transistor 660. These components are connected via electrical wire 610 in such a manner so as to provide the functionality discussed above.

Figure 5:
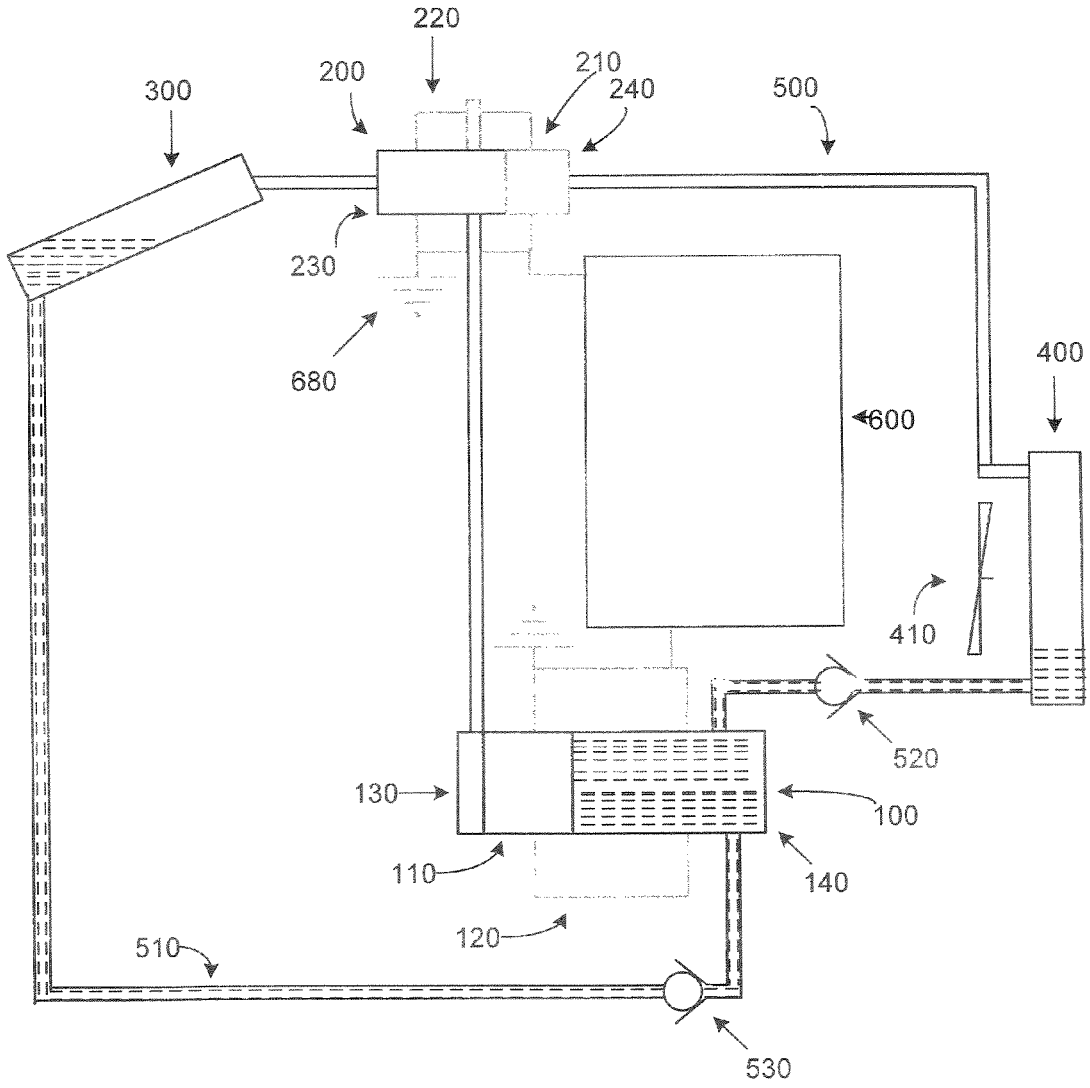
FIG. 5 depicts an electrically moderated expansion electrical generator at time $T_0$ during a cycle according to some embodiments of the invention.

With reference to FIGS. 4-16, operation of a system in accordance with some embodiments of the present invention will now be discussed. FIG. 5 depicts an electrically moderated expansion electrical generator at time $T_0$. At $T_0$ the working piston 110 may be disposed in the working spool 100 such that the working evaporator side 130 has a minimal volume while the working condenser side 140 has a maximum volume. In other words, the working piston 110 is positioned at one end of its stroke. At $T_0$, the moderating piston 210 may be disposed in the moderating spool 200 such that the moderating evaporator side 230 has a maximum volume while the moderating condenser side 240 has a minimal volume. At $T_0$ fluid in its liquid phase flows through tubing 500 from the condenser 400, through the check valve 520, through the working condenser side 140, and to the evaporator 300.

Figure 6:
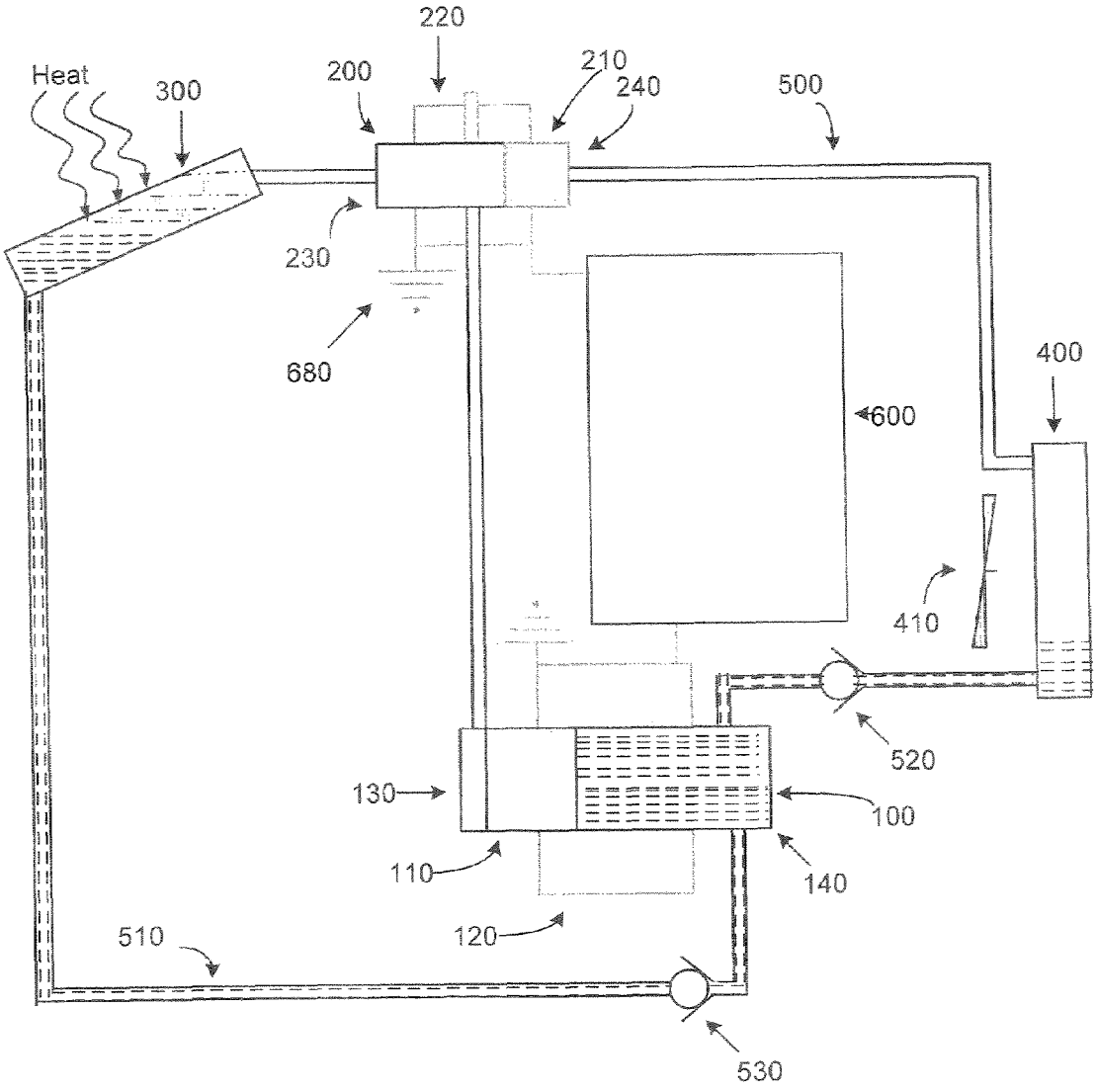
FIG. 6 depicts an electrically moderated expansion electrical generator at time $T_1$ during a cycle according to some embodiments of the invention.
Figure 7:
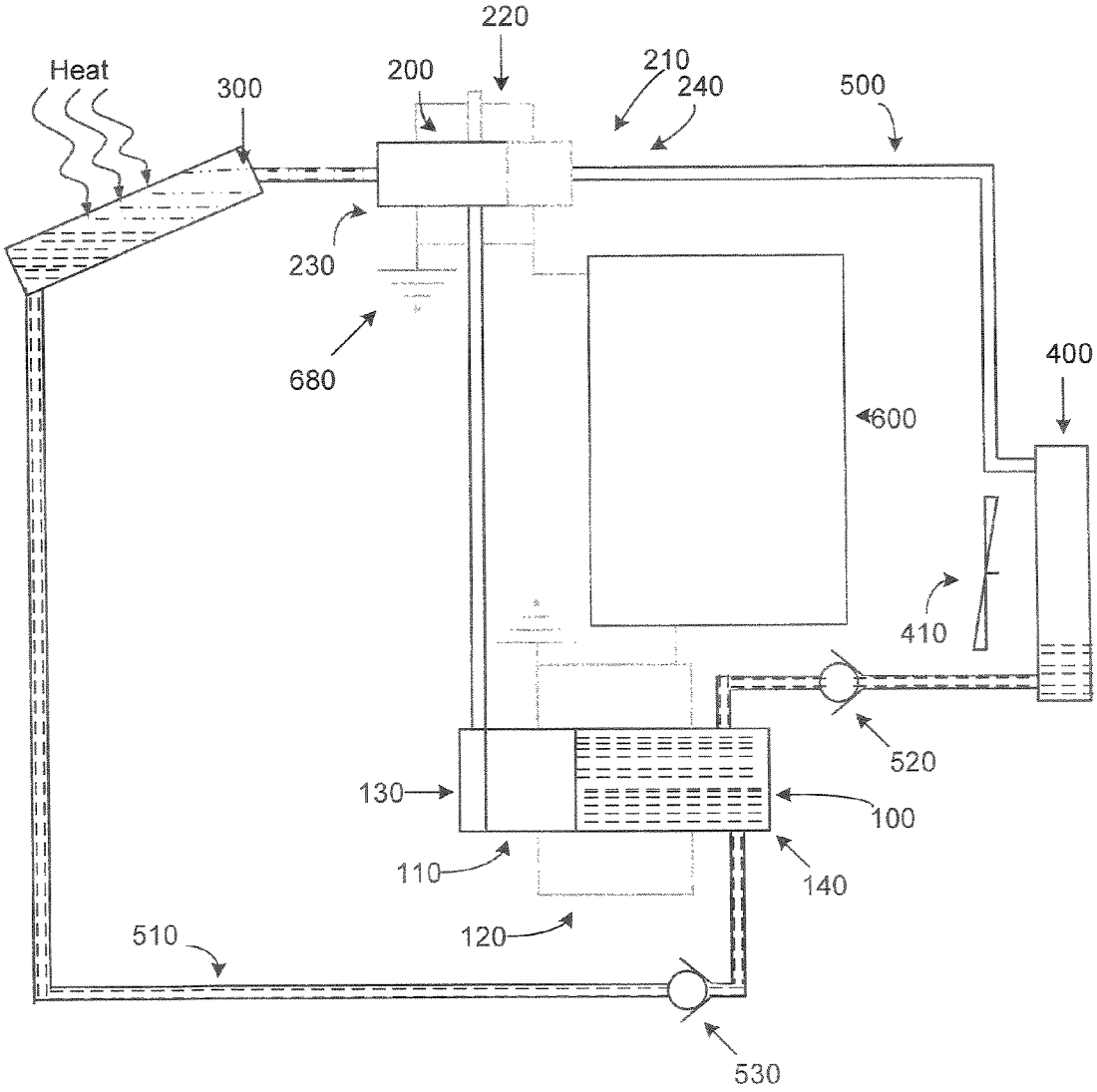
FIG. 7 depicts an electrically moderated expansion electrical generator at time $T_2$ during a cycle according to some embodiments of the invention.

As shown in FIG. 6, at time $T_1$ heat is applied to the evaporator 300, causing the liquid in the evaporator 300 to boil and release and become pressurized gas. With reference to FIG. 7, at time $T_2$ heat may be continually applied to the evaporator 300 and the pressurized gas may fill the tubing 500 leading from the evaporator 300 to the moderating spool 200.

Figure 8:
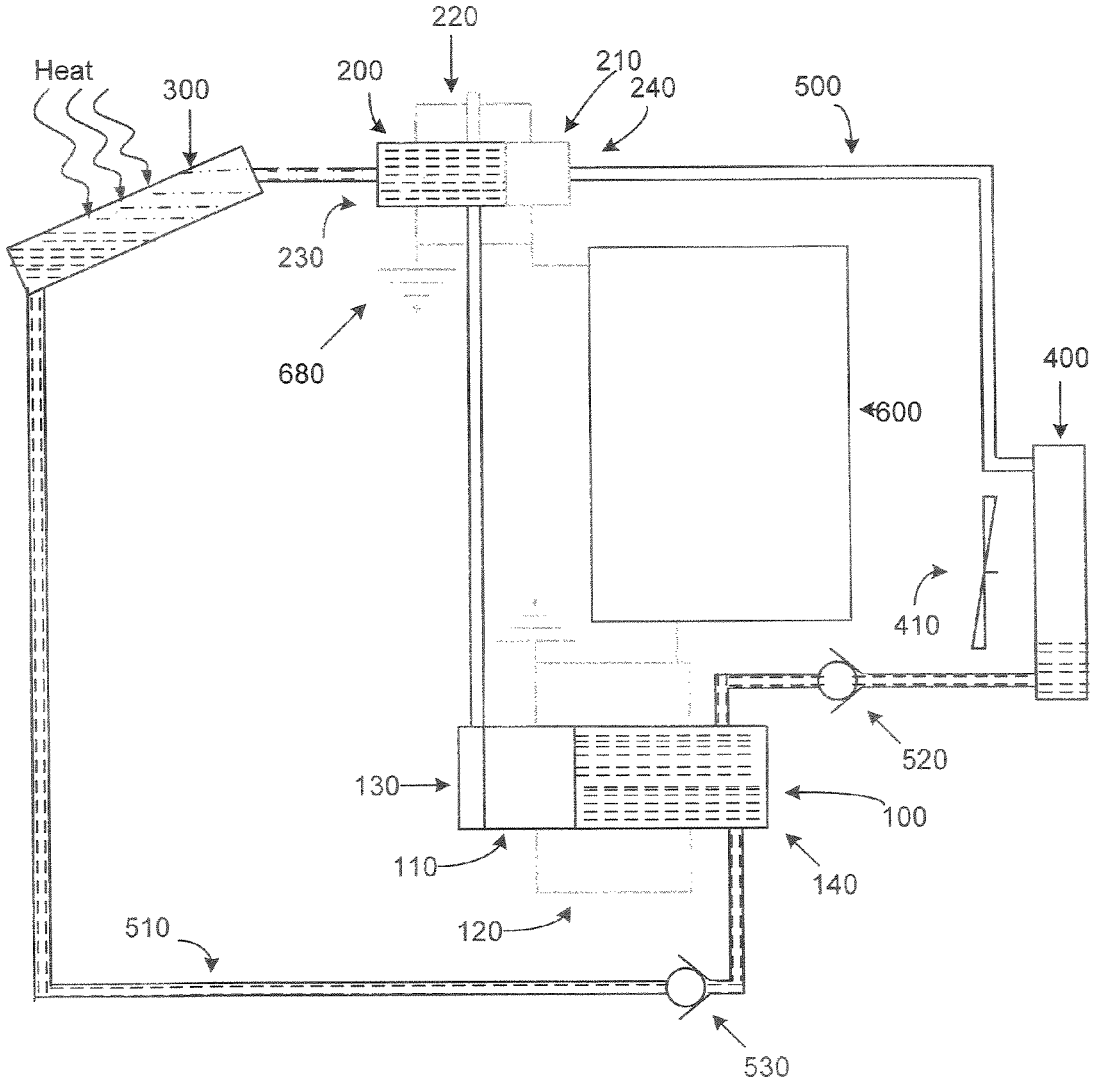
FIG. 8 depicts an electrically moderated expansion electrical generator at time $T_3$ during a cycle according to some embodiments of the invention.

At time $T_3$ and as illustrated in FIG. 8, while heat is continually applied to the evaporator 300, the pressurized gas enters and fills both the tubing 500 leading from the evaporator 300 to the moderating spool 200 and the moderating expansion volume 230 of the moderating spool 200.

Figure 9:
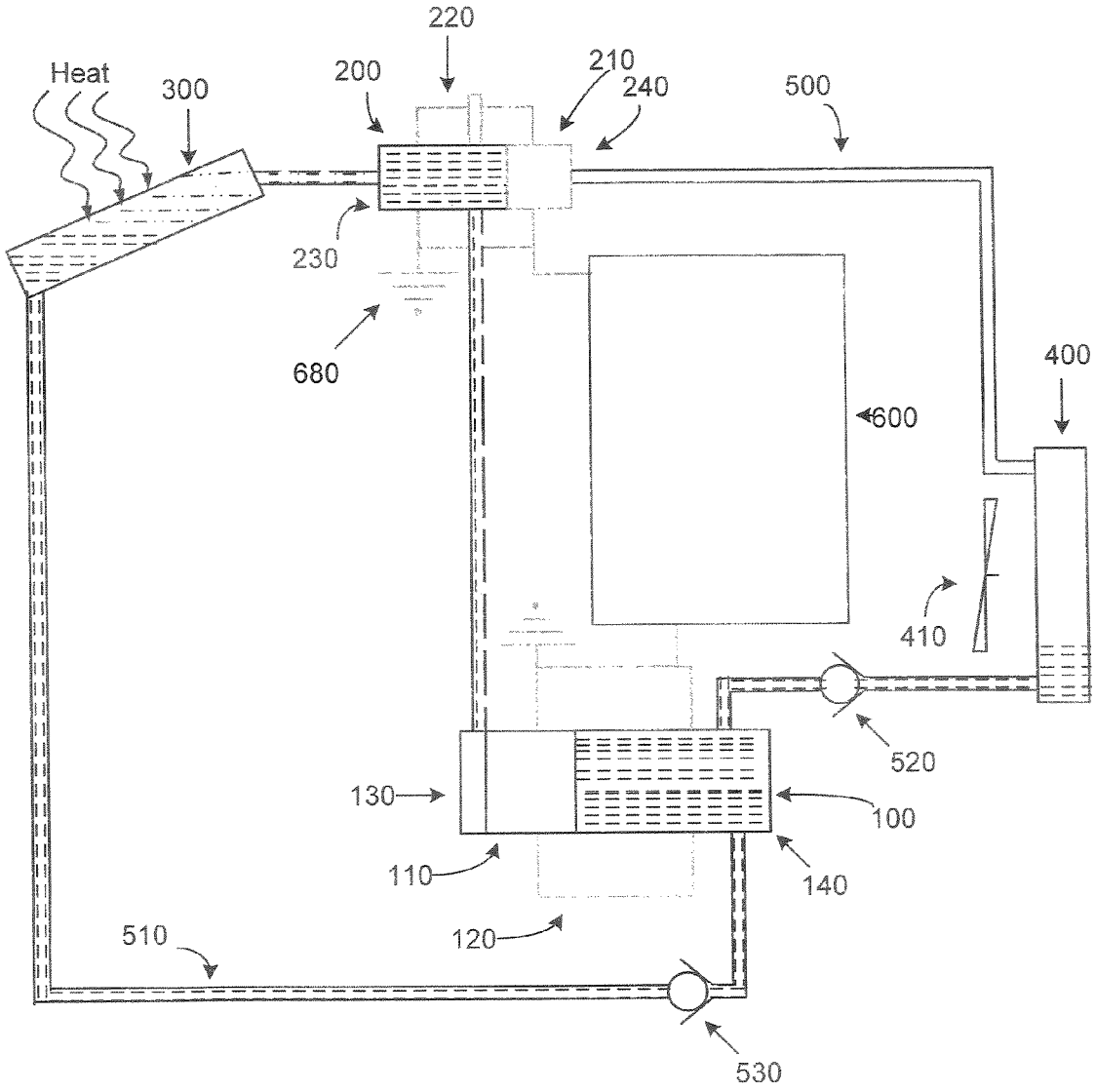
FIG. 9 depicts an electrically moderated expansion electrical generator at time $T_4$ during a cycle according to some embodiments of the invention.
Figure 10:
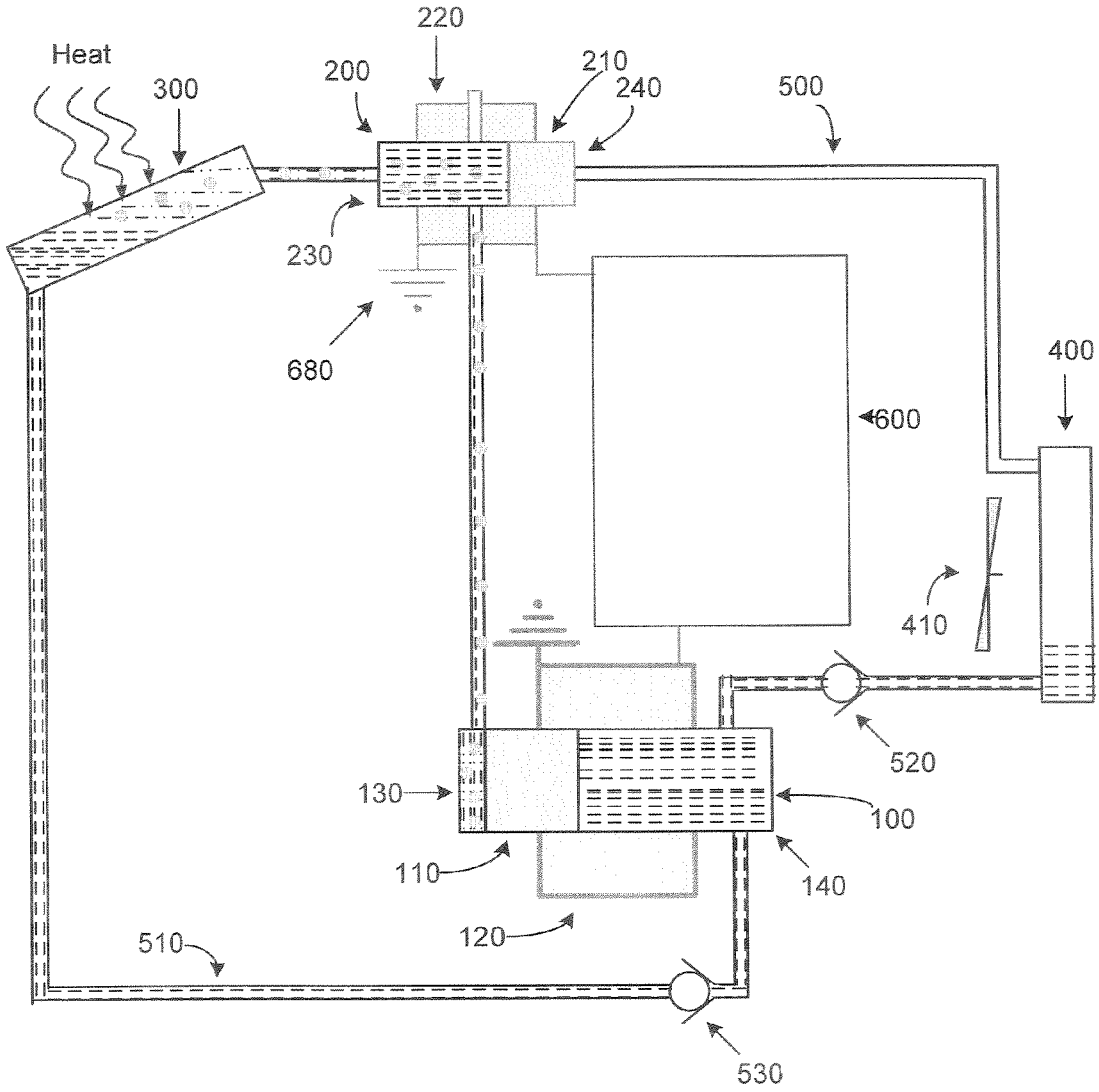
FIG. 10 depicts an electrically moderated expansion electrical generator at time $T_5$ during a cycle according to some embodiments of the invention.

As shown in FIG. 9 at time $T_4$ the pressurized gas flows to the working evaporator side 130 via the tubing 500 and the moderating evaporator side 230. In order to keep the pressure elevated and constant, condensate may be provided to the evaporator 300 from the condenser 400. As shown in FIG. 10 at time $T_5$, heat is applied to the evaporator 300, and the pressurized gas fills the tubing 500 leading from the evaporator 300 to the moderating spool 200, the moderating evaporator side 230, the tubing 500 leading from the moderating spool 200 to the working spool 100, and the available portion of the working evaporator side 130. At this time, a small current may be applied from the electrical circuit 600 to the working spool coil 120 in order to resist initial movement of the working spool piston 110.

Figure 11:
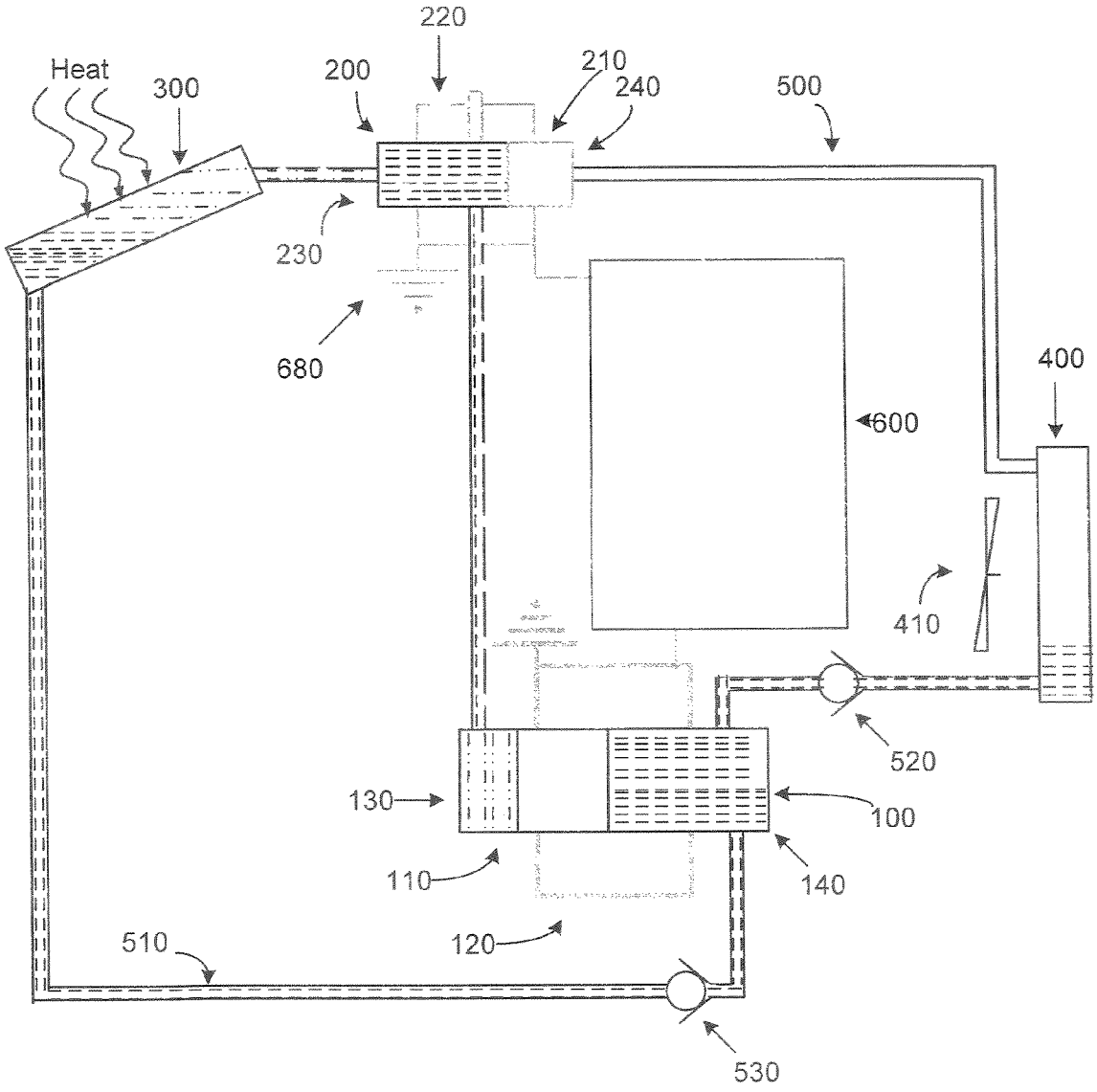
FIG. 11 depicts an electrically moderated expansion electrical generator at time $T_6$ during a cycle according to some embodiments of the invention.

At time $T_6$ and with reference to FIG. 11, increased fluid pressure in the closed system resulting from the increased heating of the fluid in the evaporator 300 may overcome the resisting force of the current applied by the working spool coil 120 to the working spool piston 110, such that the working spool piston 110 begins to move in a direction that results in increased volume of the working condenser side 130. As the working piston 110 moves through the working spool coil 120, it generates a current in the working spool coil 120 that may be applied to the electrical circuit 600. At this point, the generated current may not yet overcome the Zener diode in the electrical circuit 600, and accordingly produced electricity may be prevented from being introduced to the full electrical circuit 600.

Figure 12:
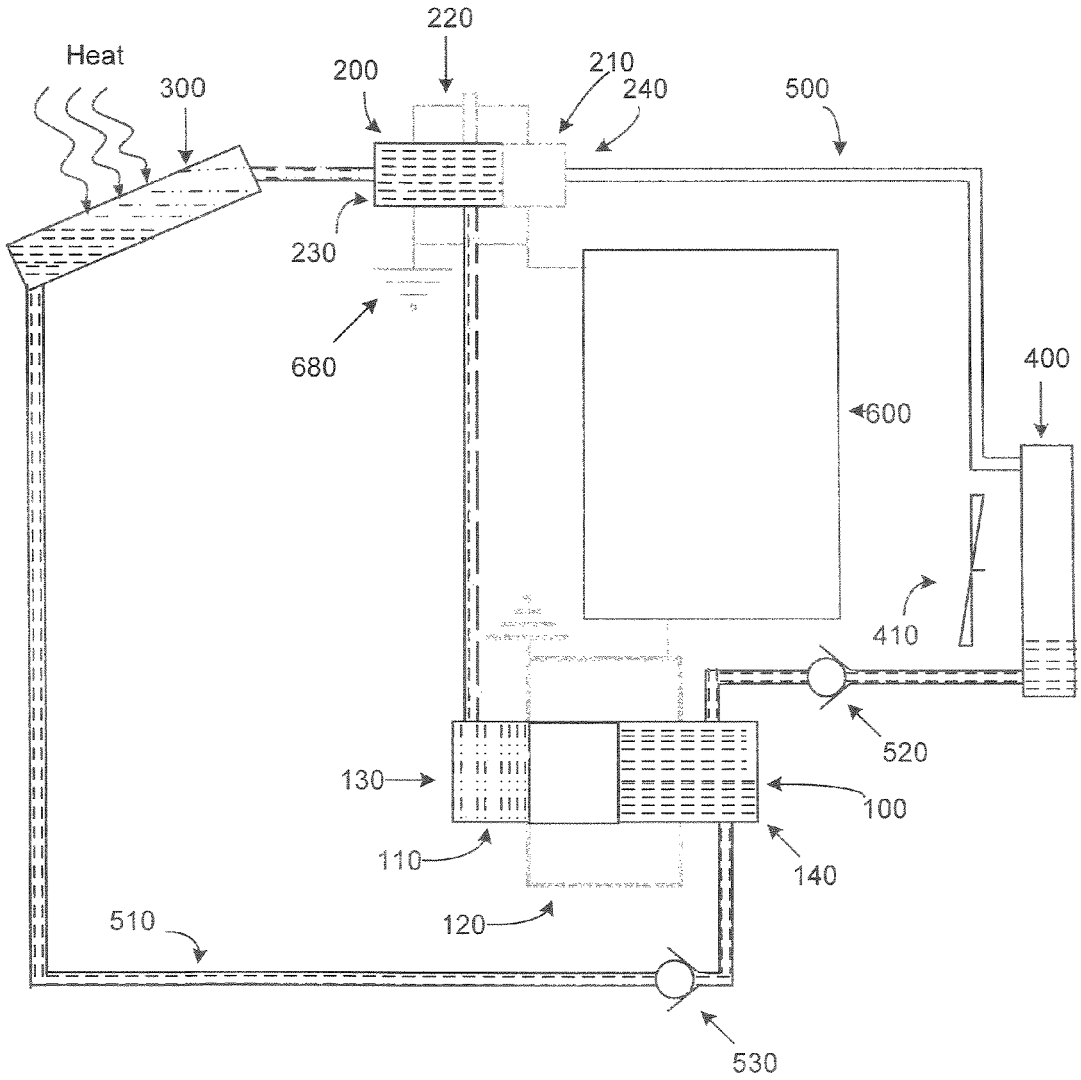
FIG. 12 depicts an electrically moderated expansion electrical generator at time $T_7$ during a cycle according to some embodiments of the invention.

As shown in FIG. 12 at time $T_7$ the working spool piston 110 continues to move in its bore away from the pressurized fluid and through the working coil 120, thereby creating a current in the working coil that may be applied to the electrical circuit 600. Again, the generated current may not yet overcome the Zener diode in the electrical circuit 600.

Figure 13:
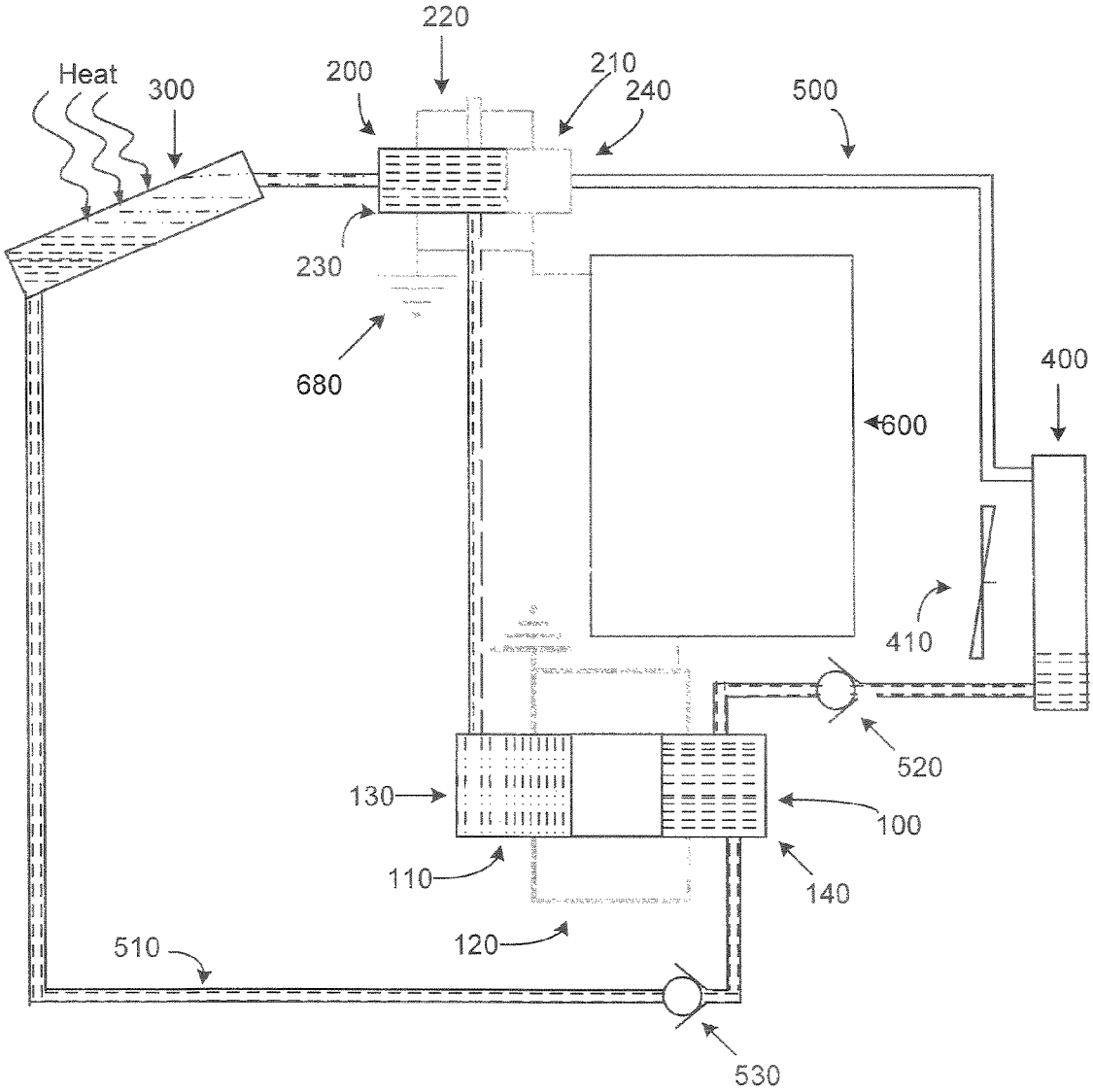
FIG. 13 depicts an electrically moderated expansion electrical generator at time $T_8$ during a cycle according to some embodiments of the invention.

FIG. 13 illustrates the system at time $T_8$. The working piston 110 is continuing its travel through its cylinder and through the working coil 120. At time $T_8$, the current generated in the working coil 120 may overcome the Zener diode and may flow through the diode 630 and may charge the power storage device 620 (e.g., battery). The generated current may also begin to charge the capacitor 650 in the electrical circuit 600.

Figure 14:
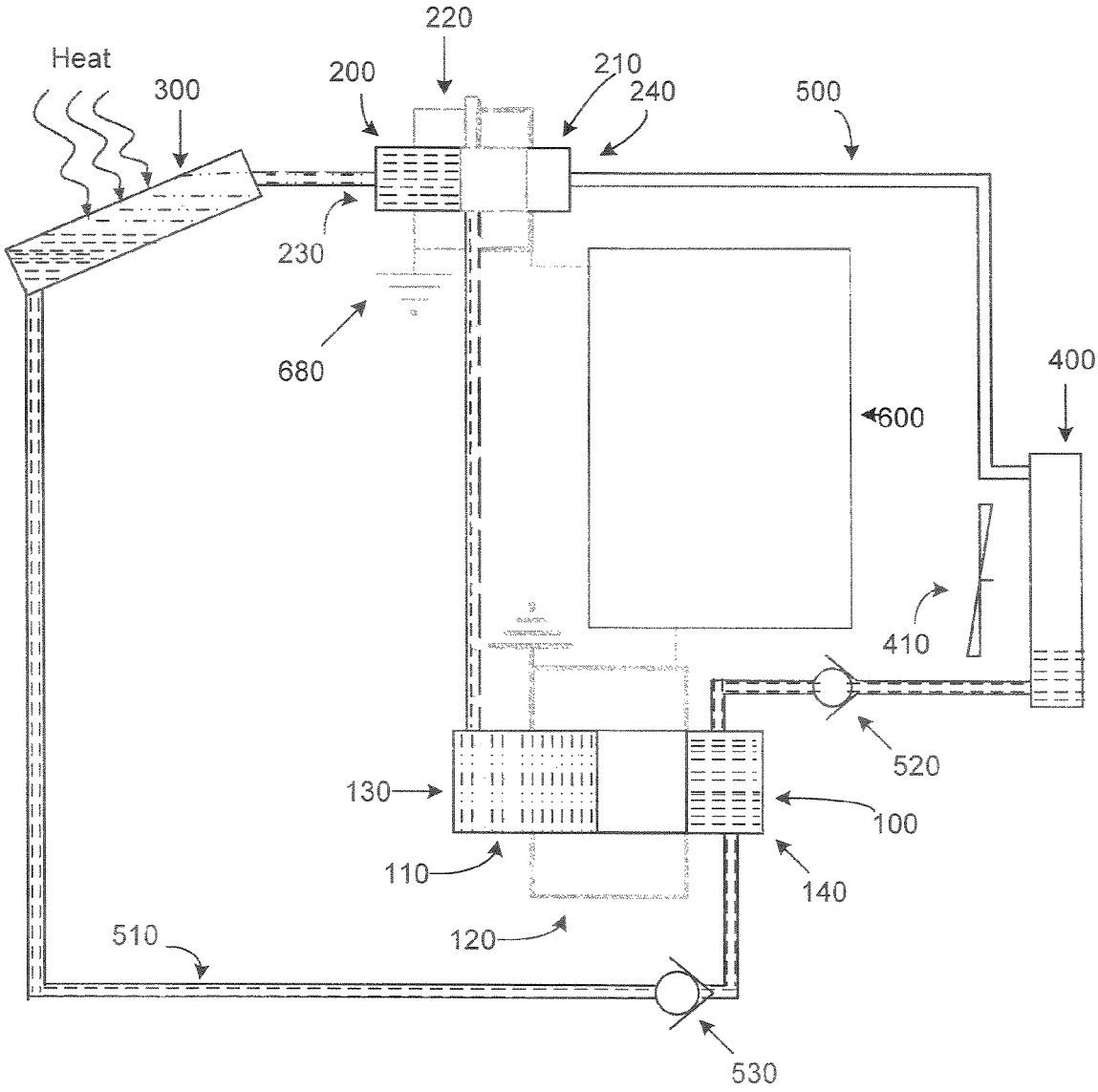
FIG. 14 depicts an electrically moderated expansion electrical generator at time $T_9$ during a cycle according to some embodiments of the invention.

At time $T_9$ and with reference to FIG. 14, the capacitor 650 that was charged by the electric current generated by the working coil 120 discharges, and a command current flows through the transistor 660 and to the moderating coil 220. As the command current flows through the moderating coil 220, a force is exerted on the moderating piston 210, causing the moderating piston 210 to move in its bore in a manner to reduce the volume in the moderating condenser side 230. In doing so, the moderating spool piston 210 blocks the tubing connecting the moderating spool 200 to the working spool 100. This prevents additional gas pressure from being provided to the working spool 100.

Figure 15:
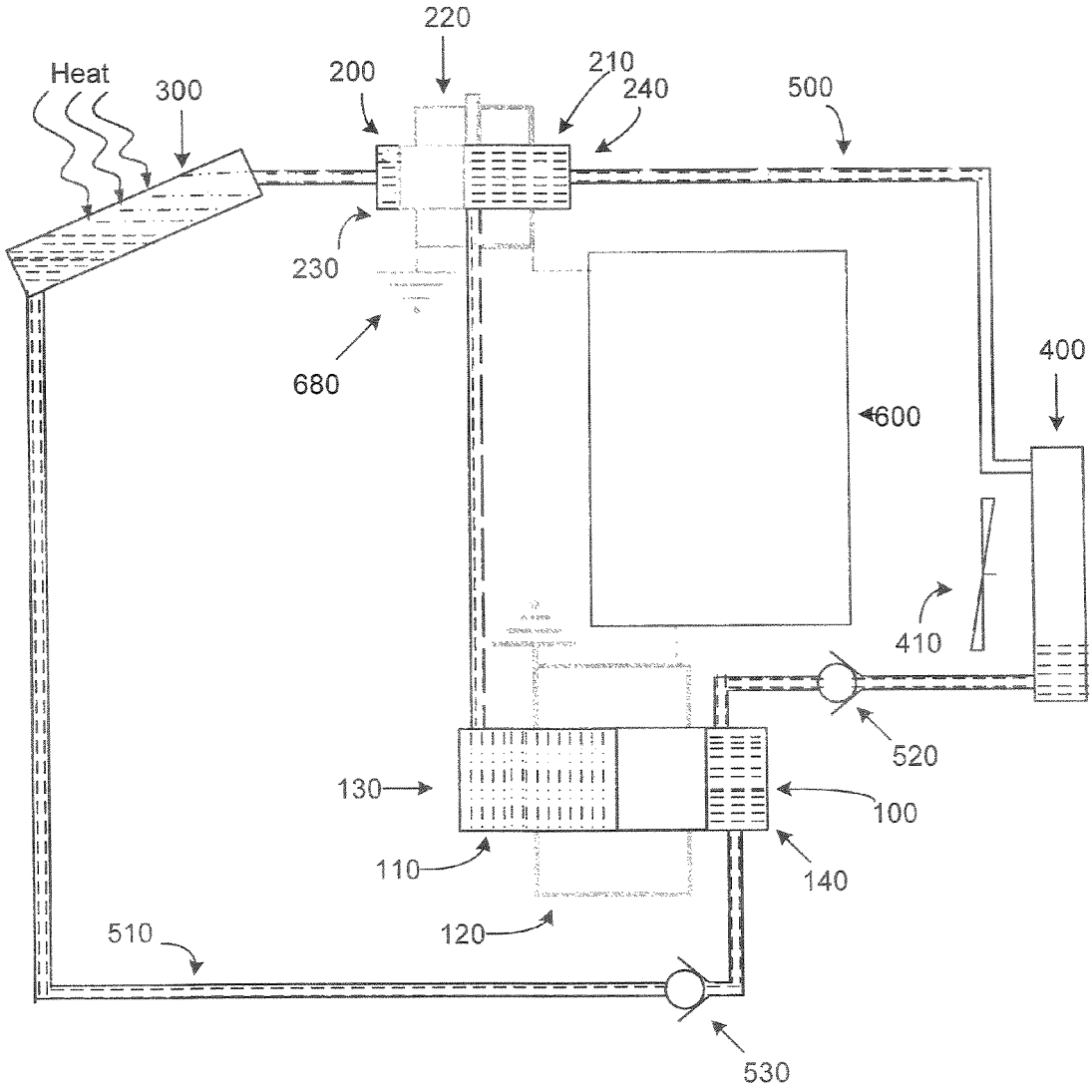
FIG. 15 depicts an electrically moderated expansion electrical generator at time $T_{10}$ during a cycle according to some embodiments of the invention.

As shown in FIG. 15, at time $T_{10}$ the capacitor 650 discharges and the command current flows through the transistor 660 and to the moderating spool coil 220. As the command current flows through the moderating spool coil 220, a force may be applied to the moderating piston 210, such that the moderating piston 210 moves in its bore in a manner to reduce the volume of the moderating evaporator side 230. When the moderating piston 210 has moved toward the moderating evaporator side 230 a sufficient amount, fluidic communication exists between the working evaporator side 130 and the moderating spool condenser side 240; communication that was previously blocked by the moderating piston 210. By opening up this communication, the addition of pressurized gas from the evaporator 300 to the working spool 100 is prevented. The pressurized gas in the working spool 100 may be released to the condenser 400 via the moderating condenser side 240 and the tubing 500. The pressure in the working evaporator side 130 may now be lower, potentially at or near ambient atmospheric pressure.

Figure 16:
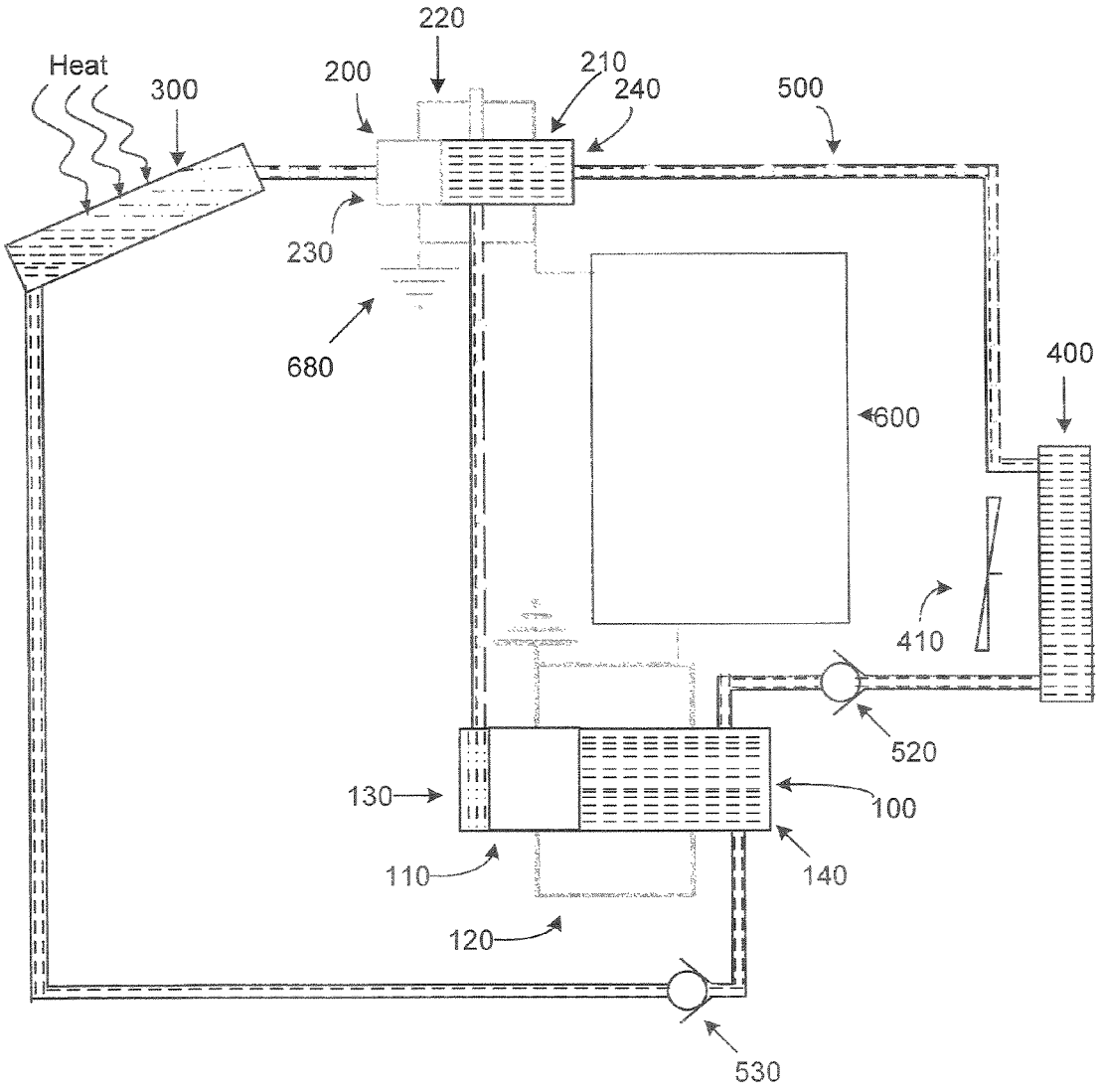
FIG. 16 depicts an electrically moderated expansion electrical generator at time $T_{11}$ during a cycle according to some embodiments of the invention.

As shown in FIG. 16, at time $T_{11}$, a command current is applied to the working coil 120, thereby causing the working piston 110 to slide within its bore in a manner to reduce the volume of the working spool expansion volume 120. Such movement may push remaining gases to the condenser 400 via the moderating condenser side 240 and the tubing 500, and may cause condensate from the condenser 400 to be drawn into the working condenser side 140 for use in the next cycle.

Finally, a command current is applied to the moderating coil 220, causing the moderating piston 210 to move in a manner to reduce the volume of the moderating condenser side 240, and accordingly block fluidic communication between the moderating condenser side 240 and the working evaporator side 130. The system is now reset and ready to repeat the cycle.

The above description relates to the operation of a closed-loop system. It will be understood that a similar method may be used to operate an open system in which the working fluid is provided continuously from a fluid source at a particular pressure and temperature and is exhausted to an exhaust environment at a pressure lower than the fluid source pressure.

It will be apparent to those skilled in the art that various modifications and variations can be made in the method, manufacture, configuration, and/or use of the present invention without departing from the scope or spirit of the invention.

What is claimed is:

1. An electrical generator for use in conjunction with a heat exchange system having an evaporator and a condenser adapted for operating on a working fluid, the evaporator having an evaporator intake port for receiving working fluid in a liquid state and an evaporator outflow port for transmission of working fluid in a gaseous state and the condenser having a condenser intake port for receiving working fluid in a gaseous state and a condenser outflow port for transmission of fluid in a liquid state, the generator comprising:

a control circuit comprising an electrical storage module and a timing module;

a moderator comprising a moderator cylinder having a moderator chamber and first, second and third moderator ports in fluid communication with the moderator chamber, the first moderator port also being in fluid communication with the evaporator outflow port and the third moderator port also being in fluid communication with the condenser intake port, a moderator coil surrounding at least a portion of the moderator cylinder, the moderator coil being in electrical communication with the control circuit, and a moderator piston comprising a magnetic body slidably disposed in the moderator chamber, the moderator piston being capable of translating between a first position wherein the first moderator port and the second moderator port are in fluid communication and a second position wherein the third moderator port and the second moderator port are in fluid communication, a working spool, comprising a working spool cylinder having a working spool chamber and first, second and third working spool ports, the first working spool port being in fluid communication with the second moderator port, the second working spool port being in fluid communication with the condenser outflow port, and the third working spool port being in fluid communication with the evaporator inlet, a working spool coil surrounding at least a portion of the working spool cylinder, the working spool coil being in electrical communication with the control circuit, a working spool piston comprising a magnetic body slidably disposed in the working spool chamber, the working spool piston dividing the working spool chamber into a condenser side volume in fluid communication with the first working spool port and an evaporator side volume in fluid communication with the second working spool port, the working spool piston being capable of translating between a first position in which the second working spool port is in fluid communication with the condenser side volume and a second position wherein the second working spool port is closed, wherein the first working spool port is configured and positioned so that when pressurized fluid is received through the first port, the pressurized fluid causes the working spool piston to translate from the first position to the second position.

2. The generator of claim 1 wherein the first position of the moderator piston prevents fluid communication between the first and second ports and the third port.

3. The generator of claim 1 wherein the second position of the moderator piston prevents communication between the first port and the second and third ports.

4. The generator of claim 1 wherein translation of the working spool piston within the working spool chamber induces an electric current in the working spool coil.

5. The generator of claim 4 wherein the electric current induced in the working spool coil is conducted to and stored in the electrical storage module of the control circuit.

6. The generator of claim 1 wherein the timing module is adapted to selectively energize the moderator coil, thereby causing the moderator piston to translate from the first position to the second position.

7. The generator of claim 6 wherein the timing module is further adapted to selectively energize the moderator coil at times determined as a function of working spool piston position.

8. The generator of claim 1 further comprising a one-way check valve disposed intermediate the condenser outflow port and the second working spool port, the check valve being configured to allow fluid flow from the condenser outflow port to the second working spool port but prevent fluid flow from the second working spool port to the condenser.

9. The generator of claim 1 further comprising a one-way check valve disposed intermediate the third working spool port and the evaporator intake port, the check valve being configured to allow fluid flow from the third working spool port to the evaporator intake port but and prevent fluid flow from the evaporator to the third working spool port.

10. An electrical generator for use in conjunction with a fluid source providing fluid at a fluid source pressure and temperature, the generator comprising:

a control circuit comprising an electrical storage module and a timing module;

a moderator comprising a moderator cylinder having a moderator chamber and first, second and third moderator ports in fluid communication with the moderator chamber, the first moderator port also being in fluid communication with the fluid source and the third moderator port also being in fluid communication with an exhaust environment at a pressure lower than the fluid source pressure, a moderator coil surrounding at least a portion of the moderator cylinder, the moderator coil being in electrical communication with the control circuit, and a moderator piston comprising a magnetic body slidably disposed in the moderator chamber, the moderator piston being capable of translating between a first position wherein the first moderator port and the second moderator port are in fluid communication and a second position wherein the third moderator port and the second moderator port are in fluid communication, a working spool, comprising a working spool cylinder having a working spool chamber and a working spool port in fluid communication with the second moderator port, a working spool coil surrounding at least a portion of the working spool cylinder, the working spool coil being in electrical communication with the control circuit, a working spool piston comprising a magnetic body slidably disposed in the working spool chamber, the working spool piston dividing the working spool chamber into a working fluid volume in fluid communication with the working spool port and an exhaust side volume, the working spool piston being capable of translating between a first position in which the working fluid volume is at a minimum and a second position wherein the working fluid volume is at a maximum, wherein the first working spool port is configured and positioned so that when pressurized fluid is received through the working spool port, the pressurized fluid causes the working spool piston to translate from the first position to the second position.

11. The generator of claim 10 wherein the first position of the moderator piston prevents fluid communication between the first and second ports and the third port.

12. The generator of claim 10 wherein the second position of the moderator piston prevents communication between the first port and the second and third ports.

13. The generator of claim 10 wherein translation of the working spool piston within the working spool chamber induces an electric current in the working spool coil that is conducted to and stored in the electrical storage module of the control circuit.

14. The generator of claim 10 wherein the timing module is adapted to selectively energize the moderator coil, thereby causing the moderator piston to translate from the first position to the second position.

15. The generator of claim 14 wherein the timing module is further adapted to selectively energize the moderator coil at times determined as a function of working spool piston position.

16. A method of generating electricity using an electrical generator incorporated into a heat exchange system having an evaporator and a condenser, the generator comprising a moderator having a moderator cylinder, coil and piston, a working spool having a working spool cylinder, coil and piston, and a control circuit, wherein the moderator and the working spool are disposed intermediate the evaporator and the condenser and are configured for controlling fluid communication therebetween, the method comprising exposing the evaporator to a heat source so that the evaporator converts at least a portion of the working fluid to a pressurized gas;

admitting the pressurized gas to a first portion of the working spool via the moderator, the pressurized gas forcing the working spool piston to translate from a first position to a second position, thereby inducing a current in the working piston coil, conducting the induced current to the control circuit for storage therein;

conducting a first command current from the control circuit to energize the moderator coil, thereby causing the moderator piston to translate from a first position to a second position to stop the flow of pressurized gas from the evaporator to the working spool and to allow pressurized gas to flow from the working spool to the condenser via the moderator;

condensing at least a portion of the pressurized gas to a liquid in the condenser;

conducting a second command current from the control circuit to energize the working spool coil, thereby causing the working spool piston to return to its first position, thereby allowing the condensed liquid to return to the evaporator via a second portion of the working spool; and terminating the command current to the moderator coil and returning the moderator piston to its first position.

17. The method of claim 16 wherein the actions of conducting a first command current and conducting a second command current are carried out as a function of working spool piston position.

18. A method of generating electricity using an electrical generator operatively connected to a fluid source providing a working fluid at a fluid source pressure and temperature, the generator comprising a moderator having a moderator cylinder, coil and piston; a working spool having a working spool cylinder, coil and piston; and a control circuit, the method comprising:

admitting the working fluid from the fluid source to a first portion of the working spool via the moderator, the working fluid forcing the working spool piston to translate from a first position to a second position, thereby inducing a current in the working piston coil;

conducting the induced current to the control circuit for storage therein;

conducting a first command current from the control circuit to energize the moderator coil, thereby causing the moderator piston to translate from a first position to a second position, thereby stopping the flow of the working fluid from the fluid source to the working spool and allowing the working fluid to flow from the working spool via the moderator to an exhaust environment at a pressure below the fluid source pressure;

conducting a second command current from the control circuit to energize the working spool coil, thereby causing the working spool piston to return to its first position; and terminating the command current to the moderator coil and returning the moderator piston to its first position.

19. The method of claim 18 wherein the actions of conducting a first command current and conducting a second command current are carried out as a function of working spool piston position.

* * * * *